US010156178B2

(12) United States Patent
Baek et al.

(10) Patent No.: US 10,156,178 B2
(45) **Date of Patent: *Dec. 18, 2018**

(54) EXHAUST SYSTEM FOR VEHICLE

(71) Applicant: HYUNDAI MOTOR COMPANY, Seoul (KR)

(72) Inventors: Hong Kil Baek, Seoul (KR); In Woong Lyo, Suwon-si (KR); Bokyung Kim, Yongin-si (KR); Seung Woo Lee, Seoul (KR); Jiyoun Seo, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 86 days.

This patent is subject to a terminal disclaimer.

(21) Appl. No.: 14/951,063

(22) Filed: Nov. 24, 2015

(65) Prior Publication Data

US 2017/0030246 A1 Feb. 2, 2017

(30) Foreign Application Priority Data

Jul. 31, 2015 (KR) ..... 10-2015-0108916

(51) Int. Cl.
*F01N 13/14* (2010.01)
*F01N 13/16* (2010.01)

(52) U.S. Cl.
CPC ..... *F01N 13/14* (2013.01); *F01N 13/16* (2013.01); *F01N 2510/02* (2013.01)

(58) Field of Classification Search
CPC ..... F01N 13/14; F01N 13/16; F01N 2510/02
USPC ..... 138/146, 145, 140, 149, 110
See application file for complete search history.

(56) References Cited

U.S. PATENT DOCUMENTS 4,341,842 A * 7/1982 Lampe ..... C09D 183/04 138/145
5,569,513 A * 10/1996 Fidler ..... C08J 9/0066 428/304.4
7,997,541 B2 * 8/2011 Pothanikat ..... F16L 55/035 248/560
2006/0264133 A1 * 11/2006 Krajewski ..... C09D 183/04 442/104
2008/0293878 A1 * 11/2008 Funk ..... C08G 77/58 524/588
2009/0022633 A1 * 1/2009 Tomosue ..... F01N 3/2853 422/177

(Continued)

FOREIGN PATENT DOCUMENTS

KR 20-1999-0028325 U 7/1999
KR 20-2000-0007791 U 5/2000
KR 10-2009-0129473 A 12/2009

(Continued)

*Primary Examiner* — Eric Keasel
*Assistant Examiner* — David Deal
(74) *Attorney, Agent, or Firm* — McDermott Will & Emery LLP

(57) ABSTRACT

An exhaust system for a vehicle includes a heat insulation coating layer formed on an inner wall surface of an exhaust gas flow tube through which exhaust gas passes. The heat insulation coating layer includes an inorganic binder including two or more silicon-based compounds and an aerogel dispersed in the inorganic binder, includes 5 to 50 parts by weight of the aerogel for 100 parts by weight of the inorganic binder, and has heat conductivity of at most 1.0 W/mK, measured by ASTM E1461.

10 Claims, 4 Drawing Sheets

(56) References Cited

U.S. PATENT DOCUMENTS

| | | | | |
|---|---|---|---|---|
| 2011/0000575 | A1* | 1/2011 | Ito | C23C 24/00 138/177 |
| 2014/0034179 | A1* | 2/2014 | Heyden | B32B 37/18 138/140 |

FOREIGN PATENT DOCUMENTS

| | | | |
|---|---|---|---|
| KR | 10-1306632 | B1 | 9/2013 |
| KR | 10-1326511 | B1 | 11/2013 |
| KR | 10-2015-0080239 | A | 7/2015 |
| WO | 2007/021493 | A2 | 2/2007 |

* cited by examiner

EXHAUST SYSTEM FOR VEHICLE

CROSS-REFERENCE TO RELATED APPLICATION

This application claims the benefit of priority to Korean Patent Application No. 10-2015-0108916, filed in the Korean Intellectual Property Office on Jul. 31, 2015, the entirety of which is incorporated herein by reference.

TECHNICAL FIELD

The present disclosure relates to an exhaust system for a vehicle, and more particularly, an exhaust system for a vehicle capable of reducing emission of exhaust gas discharged from an engine of the vehicle.

BACKGROUND

In recent years, environmental problems have become more pressing globally. To cope with this, regulations of exhaust gas for vehicles have been tightened.

Vehicle industries have invested enormous capital to develop an exhaust system for removing harmful components included in exhaust gas and have conducted many studies for a method for reducing harmful gas and enhancing fuel consumption.

As one of the methods for reducing harmful gas, a post-processing apparatus for purifying exhaust gas, for example, a diesel particulate filter (DPF) for reducing particulate materials (PMs) and nitrogen oxide (NOx), a diesel oxidation catalyst (DOC), and a Selective Catalytic Reduction (SCR) have been used in the exhaust system.

The post-processing apparatus has used metal materials such as platinum and palladium as a catalyst. To activate the catalyst, the supplied exhaust gas needs to be maintained at a predetermined temperature or more.

However, the related art takes a long time to increase a catalyst temperature using the exhaust gas after the engine starts or requires a method of increasing temperature by injecting fuel into the post-processing apparatus, a method for increasing temperature using an electric heater, etc. However, these methods may deteriorate the fuel efficiency of a vehicle.

In particular, the related art may excessively discharge the exhaust gas including a large amount of harmful ingredients due to an activation time delay of the catalyst since heat is discharged to the outside while the high-temperature exhaust gas combusted in the engine passes through an exhaust port, an exhaust manifold, etc.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide an exhaust system for a vehicle having advantages of activating a catalyst of a post-processing apparatus in a short period of time by applying a heat insulation coating layer securing high mechanical properties and heat resistance while having low heat conductivity and low volume heat capacity to an exhaust gas flow tube.

An exemplary embodiment of the present invention provides an exhaust system for a vehicle including a heat insulation coating layer formed on an inner wall surface of an exhaust gas flow tube through which the exhaust gas passes.

The heat insulation coating layer may include an inorganic binder including two or more silicon-based compounds and aerogel dispersed in the inorganic binder.

The heat insulation coating layer may include 5 to 50 parts by weight of the aerogel for 100 parts by weight of the inorganic binder.

The heat insulation coating layer may have heat conductivity of 1.0 W/mK or less which is measured by ASTM E1461.

The heat insulation coating layer may have a thickness of 10 μm to 2000 μm.

The heat insulation coating layer may have an adhesion strength of 5 or less for metal which is measured by ISO 16276-2.

The heat insulation coating layer may have a melting point of 100° C. to 500° C. which is measured by ASTM D3418.

The heat insulation coating layer may be formed in the exhaust gas flow tube including an exhaust port of a cylinder head, an exhaust manifold communicating with the exhaust port, and a front muffler communicating with the exhaust manifold.

The two or more silicon-based compounds may include two or more selected from a group consisting of silane, siloxane, silicate, silanol, silazane, and silsesquioxane.

The two or more silicon-based compounds may be silicate and silanol.

A weight ratio of the silanol to silicate may be 2 to 10.

The inorganic binder may include a sol-gel reactant of the two or more silicon-based compound.

The silicate may include a metal silicate salt.

The aerogel may include one or more compound selected from a group consisting of oxide silicon, carbon, polymer, and metal oxide.

The aerogel may have a specific surface area of 100 $cm^2/g$ to $1000/cm^2/g$.

According to an exemplary embodiment of the present invention, the catalyst of the post-processing apparatus may be activated in a short period of time by applying the heat insulation coating layer securing high mechanical properties and heat resistance while having low heat conductivity and low volume heat capacity to the exhaust gas flow tube, thereby reducing the noxious gas without consuming the additional energy.

Further, according to an exemplary embodiment of the present invention, the heat insulation coating layer may be applied to the exhaust gas flow tube to shorten the activation time of the catalyst due to the heat insulation upon the cold start.

In addition, according to an exemplary embodiment of the present invention, the heat insulation coating layer may be applied to the exhaust gas flow tube to reduce the temperature of the metal surface of the exhaust system after the warm up, thereby lowering the quality of material of the exhaust system and saving costs.

BRIEF DESCRIPTION OF THE DRAWINGS

Since the accompanying drawings are provided only to describe exemplary embodiments of the present invention, it is not to be interpreted that the spirit of the present invention is limited to the accompanying drawings.

DETAILED DESCRIPTION OF THE EMBODIMENTS

Figure 1:
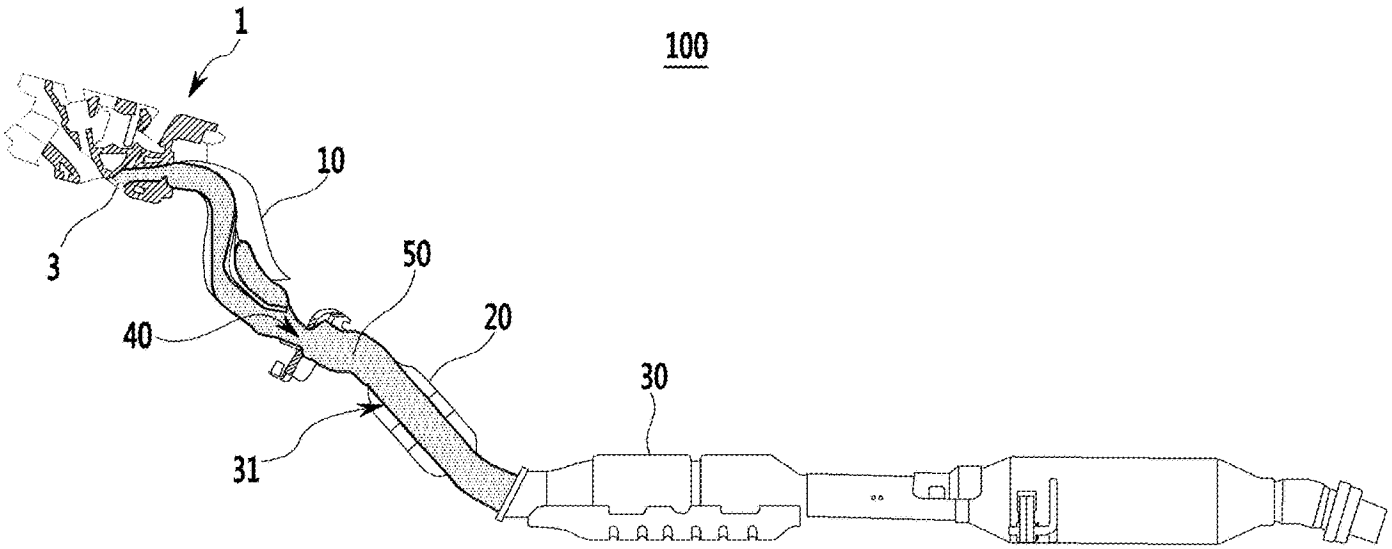
FIG. 1 is a partial cross-sectional view schematically illustrating an exhaust system for a vehicle according to an exemplary embodiment of the present invention.

Hereinafter, the present inventive concept will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Portions unrelated to the description will be omitted in order to obviously describe the present invention, and similar components will be denoted by the same reference numerals throughout the present specification.

Since sizes and thicknesses of the respective components were arbitrarily shown in the accompanying drawings for convenience of explanation, the present invention is not limited to contents shown in the accompanying drawings. In addition, thicknesses were exaggerated in order to obviously represent several portions and regions.

In the following detailed description, the same components are classified into first, second, and the like to differentiate names for components and a sequence thereof is not necessarily limited thereto.

Throughout the specification, unless explicitly described to the contrary, the word "comprise" and variations such as "comprises" or "comprising", will be understood to imply the inclusion of stated elements but not the exclusion of any other elements.

In addition, the terms "~ unit", "~ means", "~ part", "member", etc., described in the specification mean units of a comprehensive configuration for performing at least one function and operation.

FIG. 1 is a partial cross-sectional view schematically illustrating an exhaust system for a vehicle according to an exemplary embodiment of the present invention.

Referring to FIG. 1, an exhaust system 100 for a vehicle according to an exemplary embodiment of the present invention removes harmful ingredients in exhaust gas (hereinafter, referred to as "exhaust gas") discharged from an engine of a vehicle.

In the exemplary embodiment of the present invention, an example in which the exhaust system 100 is applied to an exhaust system of an engine which is an internal combustion engine of a vehicle will be described below. However, it is to be construed that the scope of the present invention is not necessarily limited thereto. Therefore, the technical ideas of the present invention may be applied as long as the exhaust system 100 has a structure which may be adopted in an exhaust system of various internal combustion engines.

The exhaust system 100 for a vehicle according to the exemplary embodiment of the present invention may include an exhaust manifold 10 communicating with an exhaust port 3 of a cylinder head 1, a front muffler 20 communicating with the exhaust manifold 10, and a post-processing apparatus 30 communicating with the front muffler 20.

Here, the post-processing apparatus 30 includes a catalyst. The catalyst may contain metal materials such as platinum and palladium. To activate the catalyst, the supplied exhaust gas needs to be maintained at a predetermined temperature or more.

The exhaust port 3, the exhaust manifold 10, the front muffler 20, and the post-processing apparatus 30 are connected to one another through an exhaust gas flow tube 40.

In the specification and claims of the present application, the exhaust gas flow tube 40 is defined as connecting an internal tube of the exhaust port 3, an internal tube of the exhaust manifold 10, and an internal tube of an exhaust pipe 31 connecting between the front muffler 20 from the exhaust manifold 10 and the post-processing apparatus 30.

The exhaust system 100 for a vehicle according to the exemplary embodiment of the present invention has a structure in which the catalyst of the post-processing apparatus 30 may be activated in a short period of time by forming a heat insulation coating layer 50 securing high mechanical properties and heat resistance while having low heat conductivity and low volume heat capacity in the exhaust gas flow tube 40.

According to the exemplary embodiment of the present invention, the heat insulation coating layer 50 may be coated on a wall surface of the internal tube of the exhaust port 3, a wall surface of the internal tube of the exhaust manifold 10, and a wall surface of the internal tube of an exhaust pipe 31 connecting between the front muffler 20 from the exhaust manifold 10 and the post-processing apparatus 30.

Hereinafter, the heat insulation coating layer 50 applied to the exhaust gas flow tube 40 of the exhaust system 100 for a vehicle according to the exemplary embodiment of the present invention and heat insulation coating compositions thereof will be described in more detail.

According to the exemplary embodiment of the present invention, the heat insulation coating layer which includes an inorganic binder including two or more silicon-based compounds and aerogel dispersed in the inorganic binder and includes 5 to 50 parts by weight of the aerogel for 100 parts by weight of the inorganic binder, and has heat conductivity of 1.0 W/mK or less which is measured by ASTM E1461 is provided.

Hereinafter, heat insulation coating compositions and the heat insulation coating layer according to the detailed implementation example of the present invention will be described in more detail.

According to one implementation example of the present invention, the heat insulation coating composition which includes the inorganic binder including the two or more silicon-based compounds; and 5 to 50 parts by weight of the aerogel for 100 parts by weight of the inorganic binder may be provided.

The present inventors completed the present invention by confirming, based on an experiment, the fact that the coating compositions obtained by mixing the inorganic binder including the at least two silicon-based compounds with the aerogel and the coating layer obtained therefrom may secure the high mechanical properties and the heat resistance while having the low heat conductivity and when the coating compositions and the coating layer are applied to the exhaust gas flow tube or the internal combustion engine under the high temperature condition, low heat conductivity property, heat resistance, etc., may be maintained for a long period of time.

In particular, since the inorganic binder including the two or more silicon-based compounds is used, even though the heat insulation coating composition is used for a long period of time under the high-temperature environment of the exhaust gas flow tube or the internal combustion engine, the heat insulation coating composition may implement excellent durability. A surface form is little changed while maintaining low heat conductivity and may not have a limitation of form by effectively dispersing the aerogel without a support, such as fiber, and the heat insulation coating composition having the improved adhesion strength and obtained by mixing the inorganic binder with the aerogel may be directly applied to the exhaust gas flow tube or a wall surface of a combustion chamber.

Examples and Experimental Examples of the present invention will be described based on the example in which the coating composition and the coating layer according to implementation examples are applied to the combustion chamber of the internal combustion engine.

In detail, the two or more silicon-based compounds include two or more selected from a group consisting of silane, siloxane, silicate, silanol, silazane, and silsesquioxane. For example, the silicate and the silanol may be used.

As described below, the silicate and the silanol may be cross-linked with each other by a condensation reaction. By including the silicate, the heat insulation coating composition may implement excellent heat resistance. Further, by including the silanol, the viscosity of the heat insulation coating composition may be controlled to be an appropriate level, an aerogel binding effect may be excellent by a crosslinking reaction, and the adhesion strength may be improved.

The silicate may include a metal silicate salt. An example of the metal silicate salt is not largely limited, but for example, compounds including alkali metal ions, alkaline earth metal ions, transition metal cations, and silicate anions may be used.

In detail, an example of the metal silicate salt may include alkali metal orthosilicate, alkali metal metasilicate, alkali metal tetrasilicate, alkali metal disilicate. In more detail, an example of the metal silicate salt may include potassium metasilicate, sodium orthosilicate, potassium disilicate, lithium orthosilicate, lithium metasilicate, lithium disilicate, rubidium disilicate, rubidium tetrasilicate, guanidine silicate, etc.

Further, the silanol compound may include a compound represented by the following Chemical Formula 1.

[Chemical Formula 1]

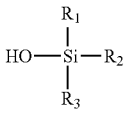

In the above Chemical Formula 1, the R1, R2, and R3 each are a hydrogen atom, a hydroxyl group, or a straight-chain or branched alkyl group having a carbon number of 1 to 10, independently from each other. The hydroxyl group means a functional group (—OH) consisting of hydrogen and oxygen and an example of the straight-chain or branched alkyl group having a carbon number of 1 to 10 is not largely limited but may include, for example, methyl, ethyl, propyl, etc.

A weight ratio of silanol to silicate may be 2 to 10, 2.3 to 7, or 2.5 to 5. If the weight ratio of silanol to silicate is below 2, a content of the silanol compound is excessively reduced, such that the adhesion strength of the heat insulation coating layer made from the heat insulation coating composition may be reduced. On the other hand, if the weight ratio of silanol to silicate exceeds 10, the content of the silicate compound is excessively reduced, such that the heat resistance of the heat insulation coating composition may be reduced.

The inorganic binder may include a sol-gel reactant of two or more silicon-based compounds. The two or more silicon-based compounds are condensed by a sol-gel reaction and thus may be cross-linked with each other. By this, a composite is formed between the two or more silicon-based compounds, thereby improving mechanical strength and physical and chemical properties.

Further, the content of the inorganic binder may be 20 wt % to 60 wt % based on a weight of the heat insulation coating composition.

Meanwhile, the heat insulation coating composition according to one implementation example may be formed by mixing the inorganic binder including the two or more silicon-based compounds with 0.1 wt % to 25 wt % of aerogel.

The mixing method is not largely limited, but generally known physical mixing methods may be used. For example, there may be a method for preparing a coating composition (coating solution) by mixing the inorganic binder including the two or more silicon-based compounds with the aerogel, adding zirconia beads thereto, and performing ball milling thereon at a speed of 100 to 500 rpm under the room temperature and normal pressure conditions.

The heat insulation coating composition according to one implementation example may provide a heat insulation material, a heat insulation structure, etc., which may be maintained for a long period of time in the internal combustion engine to which the repetitive high temperature and high pressure conditions are applied. In detail, the heat insulation coating composition according to one implementation example may be used to coat an inner surface of the internal combustion engine or parts of the internal combustion engine.

The aerogel has a structure in which microfilaments having a thickness corresponding to about 1/10,000 of a hair are entangled with each other and has porosity of 90% or more and main materials may include silicon oxide, carbon, or organic polymer. In particular, the aerogel is an ultra-low density material having high transparency and ultra-low heat conductivity due to the above-mentioned structural characteristics.

As the aerogel, a general aerogel previously known may be used. In detail, aerogel including silicon oxide, carbon, polymer, metal oxide, or a mixture of two or more thereof may be used. An example of the polymer is not largely limited, but for example, polyvinyl alcohol, polyvinyl acetate, polyvinylpyrrolidone, polystyrene sulfonic sodium salt, polyethylene oxide, polyvinylidene fluoride, polyvinylidene fluoride-hexafluoropropylene, polytetrafluoroethylene, polystyrene, polyvinyl chloride, or the like may be used.

The aerogel may have a specific surface area of 100 $cm^3/g$ to 1,000 $cm^3/g$, or 300 $cm^3/g$ to 900 $cm^3/g$.

The heat insulation coating composition may include 5 to 50 parts by weight or 10 to 45 parts by weight of the aerogel for 100 parts by weight of the inorganic binder. If the content of the aerogel is below 5 parts by weight for 100 parts by weight of inorganic binder, it may be difficult to lower the heat conductivity of the heat insulation coating layer made from the heat insulation coating composition and difficult to secure sufficient heat insulation.

Further, if the content of the aerogel exceeds 10 to 50 parts by weight for 100 parts by weight of inorganic binder, an excessive amount of aerogel is present in the heat insulation coating layer made from the heat insulation coating composition, and thus ruggedness such as a partial exposure of the surface of the aerogel to the surface of the heat insulation coating layer occurs on the surface of the heat insulation coating layer, such that an adhesion property to the inner wall of the internal combustion engine may be reduced.

The heat insulation coating composition may further include an aqueous solvent or an organic solvent. An example of the aqueous solvent is not largely limited, but for example, water, methanol, ethanol, ethylacetate, or a mixture of two or more thereof may be used.

Further, an example of the organic solvent is not largely limited, but anisole, toluene, xylene, methyl ethyl ketone, methyl isobutyl ketone and ethylene glycol monomethyl ether, ethylene glycol monoethyl ether, ethylene glycol monobutyl ether, butyl acetate, cyclohexanone, ethylene glycol monomethyl ether acetate (BCA), benzene, hexane, DMSO, N, N'-dimethylformamide, methyl alcohol, ethyl alcohol, propyl alcohol, n-butyl alcohol, iso-butyl alcohol, tert-butyl alcohol, acetone, methylene chloride, ethylene acetate, iso propyl alcohol, or a mixture of two or more thereof may be used.

A content of the aqueous solvent or the organic solvent may be 10 wt % to 80 wt % or 20 wt % to 70 wt %, based on the weight of the heat insulation coating composition.

The heat insulation coating composition may further include a surfactant, inorganic additives, a cross-linker, or a mixture of two or more thereof.

An example of the inorganic additives is not largely limited, but for example, alumina, silica, zirconia, iron oxide, silicon carbide, mullite, titanium oxide, calcium oxide, magnesium oxide, sodium oxide, potassium oxide, or a mixture of two or more thereof may be used. Preferably, the iron oxide and the zirconia may be used.

A content of the inorganic additives may be 1 wt % to 10 wt % or 4 wt % to 8 wt %, based on the weight of the heat insulation coating composition.

An example of the cross linker is not largely limited, but a silane coupling agent may be used. As an example of the silane coupling agent, aminoethyl aminopropyl trimethoxysilane (AEAPTMS), aminopropyl trimethoxy silane (APTMS), glycidoxypropyl trimethoxy silane (GPTMS), metacryl oxypropyl trimethoxysilane (MPTMS), or a mixture of two or more thereof may be used.

The content of the cross linker may be 1 wt % to 10 wt %, based on the weight of the heat insulation coating composition.

An example of the surfactant is not largely limited, but for example, polyolefin oxide-based block copolymer may be used. The polyolefin oxide-based block copolymer may include a polyolefin oxide-based repeating unit and an example of the polyolefin oxide-based repeating unit may include a polyolefin oxide repeating unit or a polypropylene oxide repeating unit. In more detail, as an example of the polyolefin oxide-based block copolymer, polyethylene oxide-polypropylene oxide, polyethylene oxide-polypropylene oxide-polyethylene oxide, or the like may be used.

The content of the surfactant may be 1 wt % to 10 wt % based on the weight of the heat insulation coating composition.

The heat insulation coating layer which includes an inorganic binder including two or more silicon-based compounds and aerogel dispersed in the inorganic binder and includes 5 to 50 parts by weight of the aerogel for 100 parts by weight of the inorganic binder, and has heat conductivity of 1.0 W/mK or less which is measured by ASTM E1461 is provided.

By using the foregoing heat insulation coating layer, the aerogel is uniformly dispersed in the inorganic binder to lower the heat conductivity and the volume heat capacity of the heat insulation coating layer, thereby greatly improving the heat resistance and the excellent durability may be implemented even at the long term use under the combustion chamber environment of the high temperature due to the high melting point.

In detail, the heat conductivity which is measured by ASTM E1461 of the heat insulation coating layer may be equal to or less than 1.0 W/mK or may be 0.1 W/mK to 0.9 W/mK or 0.2 W/mK to 0.8 W/mK. The heat conductivity means how much the material may transfer heat by conduction. Generally, the lower the heat conductivity, the transfer of the heat kinetic energy is slow, such that heat insulation may be excellent. If the heat conductivity of the heat insulation coating layer exceeds 1.0 W/mK, the transfer of the heat kinetic energy is excessively fast and thus the amount of heat energy discharged to the outside of the heat insulation coating layer is increased and the heat insulation is reduced, such that energy efficiency may be reduced.

The heat insulation coating layer may include 5 to 50 parts by weight or 10 to 45 parts by weight of the aerogel for 100 parts by weight of the inorganic binder. If the content of the aerogel is below 5 parts by weight for 100 parts by weight of inorganic binder, it may be difficult to lower the heat conductivity of the heat insulation coating layer and difficult to secure sufficient heat insulation.

Further, if the content of the aerogel exceeds 10 to 50 parts by weight for 100 parts by weight of the inorganic binder, an excessive amount of aerogel is present in the heat insulation coating layer, and thus ruggedness such as a partial exposure of the surface of the aerogel to the surface of the heat insulation coating layer occurs on the surface of the heat insulation coating layer, such that an adhesion property to the inner wall of the internal combustion engine may be reduced.

The melting point of the heat insulation coating layer which is measured by ASTM D3418 may be 100° C. to 500° C., or 200° C. to 450° C., or 250° C. to 400° C.

The thickness of the heat insulation coating layer may be 10 μm to 2,000 μm, 20 μm to 500 μm, 30 μm to 300 μm, or 50 μm to 100. As described above, the heat conductivity and the volume heat capacity of the heat insulation coating layer correspond to physical properties for a unit volume, and therefore if the thickness is changed, physical properties may be affected. If the thickness of the heat insulation coating layer is below 10 μm, the density of the heat insulation coating layer is not sufficiently reduced, such that it may be difficult to lower the heat conductivity to an appropriate level or less and reduce an internal corrosion preventing function and a surface protecting function. On the other hand, if the heat insulation coating layer exceeds 2000 μm, cracks may occur on the heat insulation coating layer.

The heat insulation coating layer may have an adhesive strength of 5 or less or 1 to 4 for metal which is measured by ISO 16276-2. An example of the method for measuring the adhesion strength may include a method for scratching the heat insulation coating layer and measuring the number of detached scratches at the time of detaching a tape.

Further, the volume heat capacity of the heat insulation coating layer which is measured by ASTM E1269 may be 600 KJ/m$^3$K to 2,500 KJ/m$^3$K, 600 KJ/m$^3$K to 2,000 KJ/m$^3$K, 700 KJ/m$^3$K to 1,900 KJ/m$^3$K, or 800 KJ/m$^3$K to 1,600 KJ/m$^3$K. The volume heat capacity means quantity of heat required to increase a temperature of a material of a unit volume by 1° and may be obtained by the following Equation 2.

$$\text{Volume heat capacity (KJ/m}^3\text{K)} = \text{specific heat (KJ/gK)} \times \text{density g/m}^3 \quad \text{[Equation 2]}$$

Therefore, if the volume heat capacity of the heat insulation coating layer exceeds 2,500 KJ/m$^3$K, the volume heat capacity is not sufficiently reduced, such that the density of the heat insulation coating layer may be increased and the heat conductivity may be increased, thereby making it difficult to acquire the targeted heat insulation.

The heat insulation coating layer according to one implementation example may provide the heat insulation material, the heat insulation structure, etc., which may be maintained for a long period of time in the internal combustion engine to which the repetitive high temperature and high pressure conditions are applied. In detail, the heat insulation coating layer according to one implementation example may be formed on the inner surface of the internal combustion engine or parts of the internal combustion engine.

The content of the inorganic binder and the aerogel includes the content of the one implementation example as described above.

The heat insulation coating layer may be formed by coating or depositing the heat insulation coating composition of the one implementation example on the inner surface of the internal combustion engine or the parts of the internal combustion engine. An example of the coating or depositing method is not largely limited, but for example, a spray coating method, etc., may be used.

For example, the heat insulation coating composition of the one implementation example is spray-coated on an object to be coated, for example, the inner surface of the internal combustion engine or outer surfaces of the parts of the internal combustion engine and is semi-dried at a temperature of 50° C. to 100° C. one time or more and the semi-dried coating composition is completely dried at a temperature of 110° C. or more to form the heat insulation coating layer. However, a detailed method for preparing a heat insulation coating layer of the implementation example is not limited thereto.

The present inventive concept will be described in more detail in the following Examples. However, the following Examples illustrate the present invention, and therefore the content of the present invention is not limited to the following Examples.

EXAMPLES 1 TO 3

Preparing of Heat Insulation Coating Composition and Heat Insulation Coating Layer (1) Preparing of Heat Insulation Coating Composition Potassium metasilicate and silanol as the silicate, pluonic as the surfactant, and aminopropyl trimethoxysilane as the cross linker were put in a container of 5 litres including an agitator and were subjected to the sol-gel reaction for 24 hours.

Next, porous silica aerogel (specific surface area of about 500 cm$^3$/g) and iron oxide and zirconia were added thereto and then were mixed, thereby preparing the heat insulation coating composition. Contents of components included in the heat insulation coating composition were described in the following Table 1.

TABLE 1

Example: Composition of heat insulation coating composition (unit: wt %)

| Division | Example 1 | Example 2 | Example 3 | Example 4 |
|---|---|---|---|---|
| Silica aerogel | 3 | 5 | 10 | 15 |
| Silicate | 10 | 10 | 10 | 10 |
| Silanol | 40 | 37 | 32 | 27 |
| Iron oxide Zirconia | 6 | 6 | 6 | 6 |
| Surfactant | 2 | 2 | 2 | 2 |
| Cross linker | 2 | 2 | 2 | 2 |
| Water | 38 | 38 | 38 | 38 |

2. Preparing of Heat Insulation Coating Layer

The heat insulation coating composition obtained by Examples 1 to 4 was coated on the inner wall surface of the combustion chamber of the vehicle by the spray coating method. Further, the heat insulation coating layer was formed by performing primary drying at 70° C. for 20 minutes and then performing secondary drying at 120° C. for 30 minutes. In this case, the thickness of the heat insulation coating layer was 75 μm.

EXPERIMENTAL EXAMPLE

Measurement of Physical Properties of Heat Insulation Coating Layer Obtained in Examples The physical properties of the heat insulation coating layer obtained in the above Examples were measured by the following method and the results thereof were shown in Tables 3 and 4.

1. Heat Conductivity (W/mK)

For the heat insulation coating layer obtained by the above Example 1, the heat conductivity was measured by a thermal diffusion measurement method using a laser flash method under the room temperature and normal pressure conditions based on ASTM E1461.

Further, the heat conductivity of the heat insulation coating layer was measured over a combustion progress time while a throttle is widely opened at 6,300 rpm within the combustion chamber formed with the heat insulation coating layer obtained in the above Example 1 and then the combustion is progressed.

2. Volume Heat Capacity (KJ/m$^3$K)

For the heat insulation coating layer obtained in Example 1, the volume heat capacity was measured by measuring the specific heat using sapphire as a reference, by a DSC apparatus at the room temperature condition based on ASTM E1269.

Further, the volume heat capacity of the heat insulation coating layer was measured over a combustion progress time while a throttle is widely opened at 6,300 rpm within the combustion chamber formed with the heat insulation coating layer obtained in the above Example 1 and then the combustion is progressed.

Results of Experimental Example for the heat conductivity and the volume heat capacity of the heat insulation coating layer according to the above Example 1 were shown in the following Table 3.

TABLE 3

| Example 1: Heat conductivity and volume heat capacity of heat insulation coating layer | | | | | | | | | |
|---|---|---|---|---|---|---|---|---|---|
| | Combustion time | | | | | | | | |
| | 0 | 2.5 | 5 | 7.5 | 10 | 12.5 | 15 | 17.5 | 20 |
| Volume heat capacity ($KJ/m^3K$) | 1,218 | 1,495 | 1,252 | 1,222 | 1,487 | 1,153 | 1,060 | 934 | 1,082 |
| Heat conductivity (W/mK) | 0.28 | 0.48 | 0.26 | 0.33 | 0.64 | 0.36 | 0.43 | 0.34 | 0.46 |

As shown in the above Table 3, in the case of the heat insulation coating layer of the above Embodiment 1, even though the combustion is progressed in the combustion chamber, the heat conductivity was maintained to be lowered to 0.64 W/mK or less. Therefore, as in the above Example 1, when the silicate binder and the silanol binder are mixed with each other, even though the mixture is used for a long period of time under the high-temperature combustion chamber environment, it could be confirmed that the heat insulation maintenance effect maintaining the low heat conductivity property is implemented.

3. Surface Property (1) After the throttle is widely opened at 6, 300 rpm within the combustion chamber formed with the heat insulation coating layer obtained in the above Example 1 and the combustion is progressed for 20 hours, the surface state of the heat insulation coating layer was confirmed by an SEM image, which was illustrated in the following FIG. 2.

Figure 2:
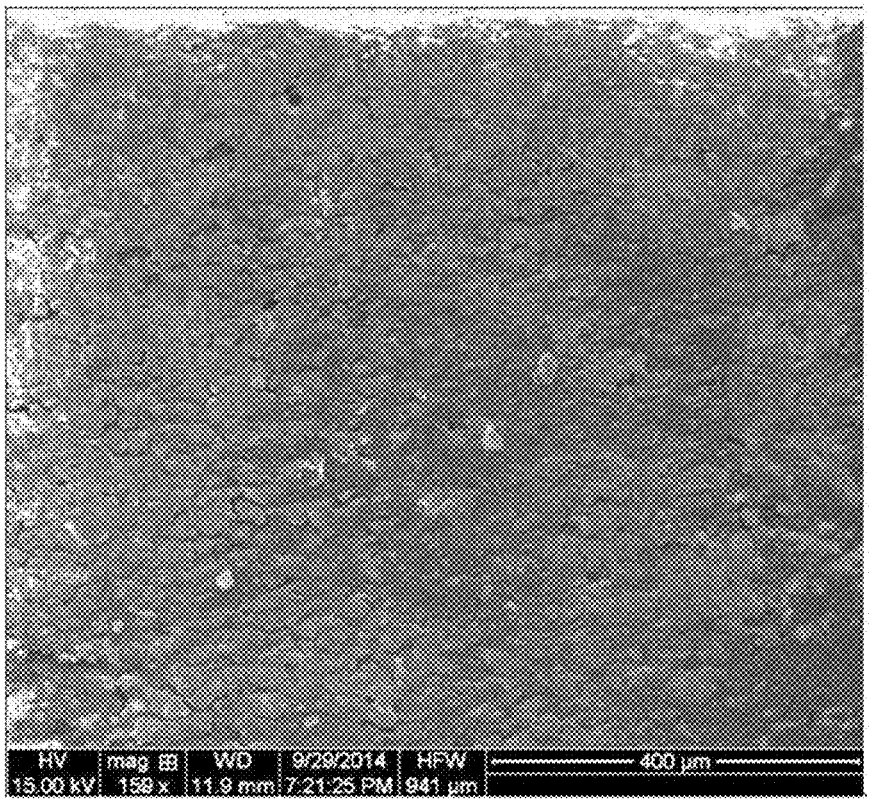
FIG. 2 is an SEM image of a heat insulation coating layer applied to the exhaust system for a vehicle according to the exemplary embodiment of the present invention.

(2) As illustrated in FIG. 2, in the case of the heat insulation coating layer of the above Example 1, even though the combustion is performed in the combustion chamber for 20 hours, the surface of the heat insulation coating layer was maintained. Therefore, as in the above Example 1, when the silicate binder and the silanol binder are mixed with each other, even though the mixture is used for a long period of time under the high-temperature combustion chamber environment, it could be confirmed that the excellent durability maintaining the surface property is implemented.

4. Melting Point (° C.)

For the heat insulation coating layer obtained in the above Example, the melting point Tm was measured using the DSC apparatus based on ASTM D3418.

5. Adhesion Strength

For the heat insulation coating layer obtained in the above Example, the adhesion strength for metal was measured using a cross cutter based on ISO 16276-2.

TABLE 5

| Example: Results of Experimental Example of melting point and adhesion strength of heat insulation coating layer | | | | |
|---|---|---|---|---|
| Division | Example 1 | Example 2 | Example 3 | Example 4 |
| Melting point (° C.) | 273 | 295 | 319 | 377 |
| adhesion strength | 1 | 1 | 2 | 3 |

As shown in the above Table 5, in the case of the heat insulation coating layer of the above Examples 1 to 4 in which the content of the aerogel is 5 wt % to 15 wt %, an appropriate amount of aerogel is contained and thus the melting point is 300° C. or more, such that sufficient heat resistance may be implemented and high adhesion strength may be measured, thereby improving applicability as the coating material.

Further, it may be confirmed that as the content of the aerogel is increased, the adhesion strength may be reduced while the heat insulation is improved and as the content of the silanol is increased, the adhesion strength of the heat insulation coating layer is improved.

As described above, according to the cylinder head 100 for the engine according to an exemplary embodiment of the present invention, the catalyst of the post-processing apparatus may be activated in a short period of time by applying the heat insulation coating layer securing high mechanical properties and heat resistance while having low heat conductivity and low volume heat capacity to the exhaust gas flow tube, thereby reducing the noxious gas without consuming the additional energy.

Further, according to an exemplary embodiment of the present invention, the heat insulation coating layer may be applied to the exhaust gas flow tube to shorten the activation time of the catalyst due to the heat insulation upon the cold start, thereby saving the discharge of exhaust gas.

That is, according to an exemplary embodiment of the present invention, the heat of the exhaust gas is less discharged to the outside due to the heat insulation coating layer upon the cold start to increase the temperature of the exhaust gas, thereby shortening the activation time of the catalyst and reducing the noxious gas of the exhaust gas.

Figure 3:
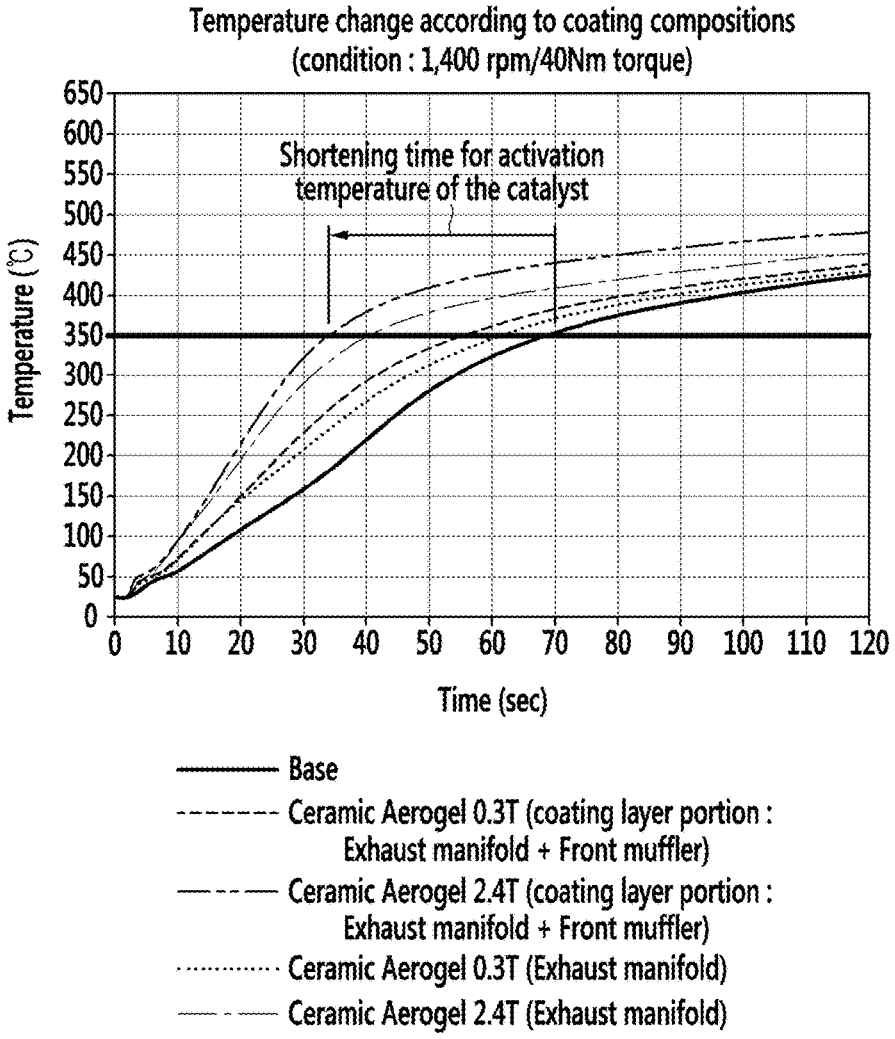
FIG. 3 is a graph showing of shortening activation time of a catalyst under a driving condition of catalyst activation (1400 rpm/40 Nm).
Figure 4:
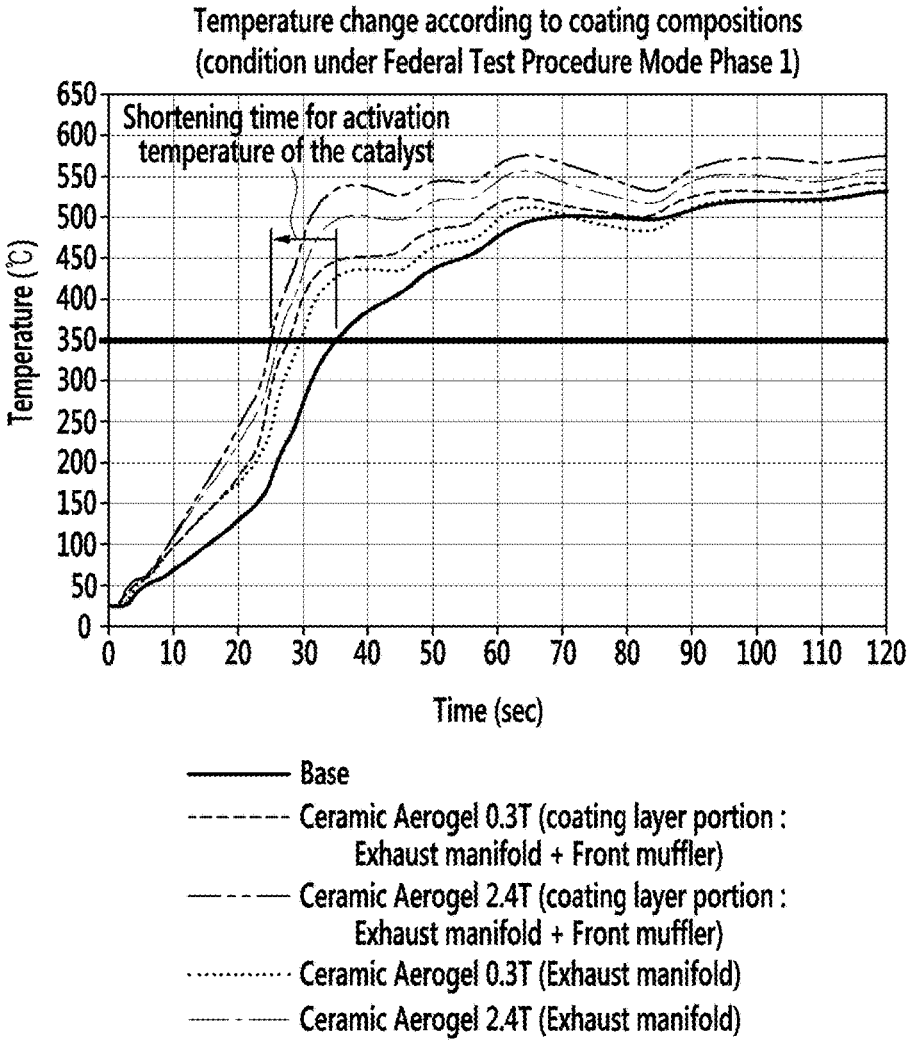
FIG. 4 is a graph showing of shortening activation time of a catalyst under Federal Test Procedure 75 condition.

Results of the experimental examples are described in the FIG. 3 and FIG. 4. FIG. 3 is a graph showing of shortening activation time of a catalyst under a driving condition of catalyst activation (1400 rpm/40 Nm) and FIG. 4 is a graph showing of shortening activation time of a catalyst under Federal Test Procedure 75 condition. These results show that each of the activation time of the catalyst may be shortened by the heat insulation coating layer.

In addition, according to an exemplary embodiment of the present invention, the heat insulation coating layer may be applied to the exhaust gas flow tube to reduce the temperature of the metal surface of the exhaust system after the warm up, thereby lowering the quality of material needed for the exhaust system and saving the manufacturing costs of the exhaust system.

Although the exemplary embodiments of the present invention are described above, the technical ideas of the present invention are not limited to the exemplary embodiments disclosed in the present specification and therefore those skilled in the art understanding the technical ideas of the present invention may easily suggest other exemplary embodiments by supplementing, changing, deleting, adding, and the like of components within the scope of the same technical ideas, and it is to be noted that these suggested embodiments are included in the scope of the present invention.

What is claimed is:

1. An exhaust system for a vehicle, comprising:

a heat insulation coating layer formed on an inner wall surface of an exhaust gas flow tube through which exhaust gas passes, wherein the heat insulation coating layer includes an inorganic binder including two or more silicon-based compounds and an aerogel dispersed in the inorganic binder, includes 5 to 50 parts by weight of the aerogel for 100 parts by weight of the inorganic binder, and has a heat conductivity of at most 1.0 W/mK, wherein the two or more silicon-based compounds are silicate and silanol, wherein a weight ratio of the silanol to the silicate is 2 to 10, and wherein the silicate includes a metal silicate salt and the metal silicate salt includes alkali metal ions, alkaline earth metal ions, transition metal cations, or silicate anions.

2. The exhaust system for a vehicle of claim 1, wherein:

the heat insulation coating layer has a thickness of 10 μm to 2000 μm.

3. The exhaust system for a vehicle of claim 1, wherein:

the heat insulation coating layer has an adhesion strength for metal of 5 or less.

4. The exhaust system for a vehicle of claim 1, wherein:

the heat insulation coating layer has a melting point of 100° C. to 500° C.

5. The exhaust system for a vehicle of claim 1, wherein:

the heat insulation coating layer is formed in the exhaust gas flow tube including an exhaust port of a cylinder head, an exhaust manifold communicating with the exhaust port, and a front muffler communicating with the exhaust manifold.

6. The exhaust system for a vehicle of claim 1, wherein:

the two or more silicon-based compounds include two or more selected from a group consisting of silane, siloxane, silicate, silanol, silazane, and silsesquioxane.

7. The exhaust system for a vehicle of claim 1, wherein:

the inorganic binder includes a sol-gel reactant of the two or more silicon-based compound.

8. The exhaust system for a vehicle of claim 1, wherein:

the silicate includes a metal silicate salt.

9. The exhaust system for a vehicle of claim 1, wherein:

the aerogel includes one or more compounds selected from a group consisting of oxide silicon, carbon, polymer, and metal oxide.

10. The exhaust system for a vehicle of claim 1, wherein:

the aerogel has a specific surface area of 100 $cm^2/g$ to 1000 $cm^2/g$.

* * * * *